US006637675B2

(12) United States Patent
Carroll, III et al.

(10) Patent No.: US 6,637,675 B2
(45) Date of Patent: Oct. 28, 2003

(54) RATE SHAPING FUEL INJECTOR WITH LIMITED THROTTLING

(75) Inventors: John T Carroll, III, Columbus, IN (US); Donald J Benson, Columbus, IN (US)

(73) Assignee: Cummins Inc., Columbus, IN (US)

( * ) Notice: Subject to any disclaimer, the term of this patent is extended or adjusted under 35 U.S.C. 154(b) by 72 days.

(21) Appl. No.: 09/903,524

(22) Filed: Jul. 13, 2001

(65) Prior Publication Data

US 2003/0010845 A1 Jan. 16, 2003

(51) Int. Cl.[7] ..... F02M 45/00

(52) U.S. Cl. ..... 239/533.4; 239/533.3; 239/533.9; 239/124; 239/127

(58) Field of Search ..... 239/88, 96, 533.2, 239/533.3, 533.4, 533.9, 124, 127; 123/445, 446, 447, 468, 472

(56) References Cited

U.S. PATENT DOCUMENTS

| | | | | |
|---|---|---|---|---|
| 2,075,949 | A | | 4/1937 | Lemon |
| 2,243,011 | A | | 5/1941 | L'Orange |
| 2,959,360 | A | | 11/1960 | Nichols |
| 3,339,848 | A | | 9/1967 | Geiger |
| 4,151,958 | A | | 5/1979 | Hofmann |
| 4,168,804 | A | | 9/1979 | Hofmann |
| 4,187,825 | A | | 2/1980 | Loyd, Jr. |
| 4,200,237 | A | | 4/1980 | Urlaub et al. |
| 4,202,500 | A | | 5/1980 | Keiczek |
| 4,215,821 | A | | 8/1980 | Eblen |
| 4,269,360 | A | | 5/1981 | Kopse |
| 4,285,471 | A | | 8/1981 | Eblen et al. |
| 4,382,554 | A | | 5/1983 | Hofmann |
| 4,546,739 | A | | 10/1985 | Nakajima et al. |
| 4,570,853 | A | * | 2/1986 | Schmied ..... 239/533.3 |
| 4,658,824 | A | | 4/1987 | Scheibe |
| 4,736,712 | A | | 4/1988 | Savkar et al. |
| 4,758,169 | A | | 7/1988 | Steiger |
| 4,826,080 | A | | 5/1989 | Ganser |
| 4,856,713 | A | | 8/1989 | Burnett |

(List continued on next page.)

FOREIGN PATENT DOCUMENTS

| | | |
|---|---|---|
| GB | 2 266 559 A | 11/1993 |
| JP | 4-140468 A | 5/1992 |

*Primary Examiner*—Steven J. Ganey
(74) *Attorney, Agent, or Firm*—Nixon Peabody LLP; Tim L. Brackett, Jr.

(57) ABSTRACT

A closed needle injector assembly is provided which effectively permits low fueling quantity control in short duration injections and pilot quantity control in longer duration events without compromising energy efficiency, maximum fuel delivery rates nor requiring increased operating pressures. The closed needle injector assembly includes first and second needle valve elements and a throttle passage formed in the second needle valve element to restrict fuel flow through an injector orifice. The second needle valve element is telescopingly received within the first needle valve element. Respective control volumes and one or more injection control valves are used to control the movement of the needle valve elements. Operation of the assembly results in movement of the first needle valve element to an open position for throttling fuel flow through the throttle passage followed by subsequent lifting of the second needle valve element for longer duration injections.

26 Claims, 9 Drawing Sheets

U.S. PATENT DOCUMENTS

| | | | | |
|---|---|---|---|---|
| 4,958,605 | A | | 9/1990 | O'Neal et al. |
| 4,984,738 | A | | 1/1991 | Winquist |
| 5,199,398 | A | | 4/1993 | Nylund |
| 5,341,783 | A | | 8/1994 | Beck et al. |
| 5,458,292 | A | | 10/1995 | Hapeman |
| 5,463,996 | A | | 11/1995 | Maley et al. |
| 5,535,723 | A | | 7/1996 | Gibson et al. |
| 5,588,412 | A | | 12/1996 | Nozaki |
| 5,647,316 | A | | 7/1997 | Hellen et al. |
| 5,647,536 | A | | 7/1997 | Yen et al. |
| 5,676,114 | A | | 10/1997 | Tarr et al. |
| 5,711,277 | A | | 1/1998 | Fuseya |
| 5,732,679 | A | | 3/1998 | Takahasi et al. |
| 5,765,755 | A | | 6/1998 | Peters et al. |
| 5,860,597 | A | | 1/1999 | Tarr |
| 5,884,611 | A | | 3/1999 | Tarr et al. |
| 5,899,389 | A | | 5/1999 | Pataki et al. |
| 6,056,264 | A | | 5/2000 | Benson et al. |
| 6,155,503 | A | | 12/2000 | Benson et al. |
| 6,220,528 | B1 | * | 4/2001 | Cooke et al. ..... 239/533.3 |
| 6,340,121 | B1 | * | 1/2002 | Lambert ..... 239/533.4 |
| 6,378,503 | B1 | * | 4/2002 | Lambert ..... 123/468 |

* cited by examiner

TYPICAL HIGH PRESSURE INJECTION

RATE SHAPING FUEL INJECTOR WITH LIMITED THROTTLING

TECHNICAL FIELD

This invention relates to an improved fuel injector which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. A commonly used injector is a closed needle injector which includes a needle assembly having a spring-biased needle valve element positioned adjacent the needle orifices for resisting blow back of exhaust gas into the pumping or metering chamber of the injector while allowing fuel to be injected into the cylinder. The needle valve element also functions to provide a deliberate, abrupt end to fuel injection thereby preventing a secondary injection which causes unburned hydrocarbons in the exhaust. The needle valve is positioned in a needle cavity and biased by a needle spring to block fuel flow through the needle orifices. In many fuel systems, when the pressure of the fuel within the needle cavity exceeds the biasing force of the needle spring, the needle valve element moves outwardly to allow fuel to pass through the needle orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector (also referred to as a pilot-actuated needle controlled injector).

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed needle fuel injector systems. One method of controlling the initial rate of fuel injection is to spill a portion of the fuel to be injected during the injection event. For example, U.S. Pat. No. 5,647,536 to Yen et al. discloses a closed needle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the needle cavity. However, the needle valve is not servo-controlled and, thus, this needle assembly does not include a control volume for controlling the opening and closing of the needle valve. Moreover, the rate shaping needle assembly does not permit the rate to be selectively varied.

Other rate shaping systems decrease rate of fuel flow during the initial portion of the injection event by, for example, throttling the fuel to the needle orifices. However, many of these systems restrict the flow of fuel throughout the injection event thereby disadvantageously restricting pressure throughout the injection event. This approach is not energy efficient, limits maximum delivery rates and requires increased fuel system operating pressures to maintain maximum desired injection pressures. Other throttling type systems, such as disclosed in FIGS. 6*a* and 6*b* of Yen et al., restrict the flow of fuel during the initial portion of an injection event while permitting unrestricted delivery during a later portion. This system uses a single needle valve element which is not servo-controlled.

Although some systems discussed hereinabove create different rate shapes, further improvement is desirable. Therefore, there is need for a servo-controlled fuel injector for providing enhanced selective control over injection timing and duration and variable control of injection rate shaping.

SUMMARY OF THE INVENTION

It is an object of the present invention, therefore, to overcome the disadvantages of the prior art and to provide a fuel injector which is capable of effectively and predictably controlling the rate of fuel injection.

It is another object of the present invention to provide a servo-controlled injector capable of effectively controlling the flow rate of fuel injected during each injection event so as to minimize emissions.

It is another object of the present invention to provide a servo-controlled injector assembly capable of shaping the rate of fuel injection which is also simple and inexpensive to manufacture.

It is yet another object of the present invention to provide an injector capable of effectively slowing down the rate of fuel injection during the initial portion of an injection event while subsequently increasing the rate of injection to rapidly achieve a high injection rate.

It is a further object of the present invention to provide an injector for use in a variety of fuel systems, including common rail system, accumulator pump systems and pump-line-needle fuel systems, which effectively controls the rate of injection at each cylinder location.

Still another object of the present invention is to provide a rate shaping injector which is capable of controlling the rate of fuel injection to achieve a more favorable fuel gain response.

Yet another object of the present invention is to provide an injector which permits effective control of fuel injection quantities during small quantity pilot and post injections while permitting injection rate shaping.

Another object of the present invention is to provide a servo-controlled injector which avoids increasing fuel system operating pressures to achieve rate shaping via throttling.

These and other objects of the present invention are achieved by providing a closed nozzle injector assembly for injecting fuel at high pressure into the combustion chamber of an engine, comprising an injector body containing an injector cavity and an injector orifice communicating with one end of the injector cavity to discharge fuel into the combustion chamber wherein the injector body includes a fuel transfer circuit for transferring supply fuel to the injector orifice. The injector also includes a first needle valve element positioned in the injector cavity for controlling fuel flow through the injector orifice and a first valve seat formed on the injector body. The first needle valve element may be movable between a closed position against the first valve seat blocking flow through the injector orifice and an open position permitting flow through the injector orifice. A second needle valve element is also provided which is positioned in the injector cavity and movable between a closed position against a second valve seat blocking fuel flow across the second valve seat and an open position permitting fuel flow across the second valve seat. A throttle passage is formed in the second needle valve element to restrict fuel flow upstream of the injector orifice.

A first needle valve element is preferably an inner needle valve element telescopingly received within a cavity formed in the outer needle valve element. The throttle passage preferably extends through the outer needle valve element. The injector assembly also preferably includes a first control volume positioned adjacent an outer end of the first needle valve element for receiving fuel and a second control volume positioned adjacent an outer end of the second needle valve element for receiving fuel. An injection control valve means is preferably provided for controlling the flow of fuel from the first and the second control volumes. An outer supply cavity may surround the outer needle valve element while an inner supply cavity may be positioned within the outer needle valve element. In this design, the throttle passage fluidically connects the outer supply cavity to the inner supply cavity while being sized to restrict fuel flow to the inner supply cavity.

The injector may further include a drain circuit for draining fuel from the first control volume and the second control volume to a low pressure drain. The injection control valve or valves may further include a first injection control valve positioned along the drain circuit for controlling the flow of fuel through the drain circuit to control the movement of the first needle valve element between the open and closed positions and a second injection control valve positioned along the drain circuit for controlling the flow of fuel through the drain circuit to control the movement of the second needle valve element between the open and closed positions. The first and the second injection control valves may each include an actuator and a reciprocally mounted, selectively movable control valve member. The injector may further include a first biasing spring for biasing the first needle valve element toward the closed position and a second biasing spring for biasing the needle valve element toward the closed position, wherein both the first and the second biasing springs are positioned within the cavity formed in the second needle valve element. The first and the second biasing springs may be positioned in nonoverlapping serial relationship along a longitudinal axis. The actuators for the first and the second needle valve elements may be positioned adjacent one another in side-by-side relationship with respective axes of reciprocation of the control valve members positioned in parallel.

The throttle passage may extend transversely through the second needle valve element from the outer supply cavity to the inner supply cavity. More specifically, the throttle passage may extend substantially perpendicular to a longitudinal axis of the injector body. Also, the injector of the present invention may include a land formed on an inner portion of the second needle valve element immediately adjacent the second valve seat. The land functions as a lift control means positioned within the inner supply cavity for controlling the movement of the second needle valve element from the closed position. The land is exposed to fuel in the inner supply cavity to generate fuel pressure forces that operate to delay the opening of the second needle valve element.

DETAILED DESCRIPTION OF THE INVENTION

Figure 1:
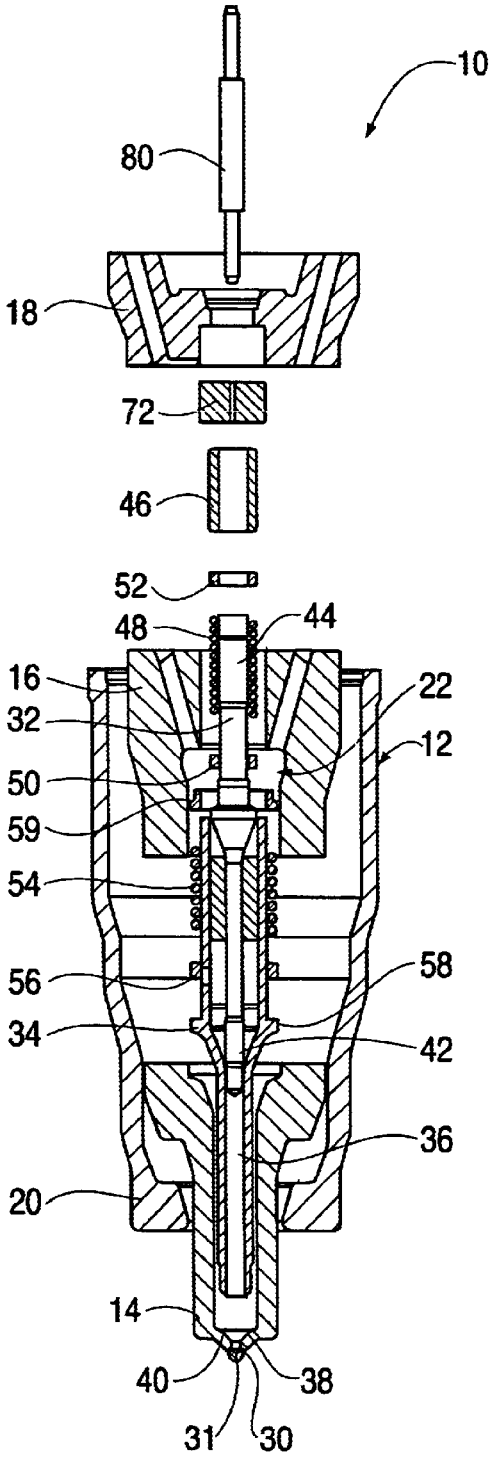
FIG. 1 is an exploded cross sectional view of the closed nozzle injector of the present invention.
Figure 2:
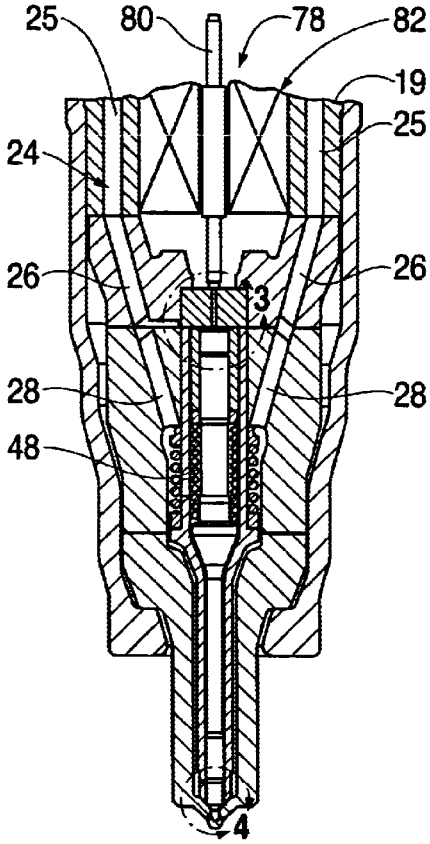
FIG. 2 is an assembled, enlarged cross sectional view of the closed nozzle injector of FIG. 1.

Referring to FIGS. 1 and 2, there is shown the closed needle injector of the present invention, indicated generally at 10, which is capable of effectively controlling the injection flow rate during low fuel quantity injection events, i.e. short duration injections, and during the initial portion of longer duration injections to achieve a more favorable fueling gain response without compromising energy efficiency, maximum fuel delivery rates, nor requiring increased operating pressures. Closed needle injector 10 generally includes an injector body 12 formed from a cup 14, spring housing 16, valve housing 18, actuator housing 19 and retainer 20 for holding cup 14, spring housing 16 and valve housing 18 in compressive abutting relationship. For example, retainer 20 may contain internal threads for engaging corresponding external threads on an upper barrel (not shown) to permit the entire injector body 12 to be held together by simple relative rotation of retainer 20 with respect to the upper barrel. Injector body 12 includes an injector cavity, indicated generally at 22, formed in cup 14, spring housing 16 and valve housing 18. Injector body 12 further includes a fuel transfer circuit 24 comprised, in part, of delivery passages 25, 26 and 28 formed in actuator housing 19, valve housing 18 and spring housing 16, respectively, for delivering fuel from a high pressure source to injector cavity 22. Injector body 12 also includes a plurality of injector orifices 30 fluidically connecting injector cavity 22, and specifically a mini-sac 31, with a combustion chamber of an engine (not shown). Injector 10 is positioned in a receiving bore (not shown) formed in, for example, the cylinder head of an internal combustion engine.

The closed needle injector 10 of the present invention can be adapted for use with a variety of fuel systems. For example, closed needle injector 10 may receive high pressure fuel from a high pressure common rail or alternatively, a dedicated pump assembly, such as in a pump-line-nozzle system or a unit injector system incorporating, for example, a mechanically actuated plunger into the injector body. The injection rate shaping needle assembly of the present invention may also be incorporated into the fuel injectors and fuel system disclosed in U.S. Pat. No. 5,676,114 entitled Needle Controlled Fuel System With Cyclic Pressure Generation, the entire contents of which is hereby incorporated by reference. Thus, closed needle injector assembly 10 of the present invention may be incorporated into any fuel injection system which supplies high pressure fuel to fuel transfer circuit 28 while permitting the injector elements discussed hereinbelow to control the timing, quantity and rate shape of the fuel injected into the combustion chamber.

Closed needle injector assembly 10 also includes a first or inner needle valve element 32 and a second or outer needle valve element 34 both positioned for reciprocal movement within injector cavity 22. Specifically, outer needle valve element 34 has a generally cylindrical shape forming an inner cavity 36 for receiving inner needle valve element 32. A first or inner valve seat 38 is formed on the inner surface of cup 14 upstream of injector orifices 30. When inner needle valve element 32 is in a closed position as shown in FIG. 2, the lower end of inner needle valve element 32 abuts inner valve seat 38 so as to prevent fuel flow from injector cavity 22 and cavity 36 into injector orifices 30 as discussed more fully hereinbelow. A second or outer valve seat 40 is formed on the inner surface of cup 14 outwardly from inner valve seat 38 for abutment by the lower end of outer needle valve element 34 when in a closed position. A lower guiding surface 42 formed on inner needle valve element 32 is sized to form a close sliding fit with the inner surface of outer needle valve element 34 to create a fluid seal while permitting unhindered reciprocal movement of the needle valve elements. Likewise, an upper guiding surface 44 is formed on inner needle valve element 32 and sized to form a close sliding fit with the inner surface of a separator 46 positioned within the upper end of outer needle valve element 34 so as to create a fluid seal. Likewise, the outer surface of separator 46 is sized to form a close sliding fit with the inner surface of outer needle valve element 34 while also creating a fluid seal.

Closed needle injector assembly 10 also includes a first or inner needle biasing spring 48, i.e. coil spring, positioned within cavity 36 of outer needle valve element 34 for biasing inner needle valve element 32 into the closed position as shown in FIG. 2. The lower end of inner biasing spring 48 engages an inner needle shim or seat 50 positioned in abutment against a land formed on inner needle valve element 32. The upper end of inner needle biasing spring 48 is seated against a spacer 52 positioned in abutment against the inner end of separator 46. Closed needle injector assembly 10 also includes a second or outer needle biasing spring 54, i.e. coil spring, positioned in injector cavity 22 around the outer surface of outer needle valve element 34. Thus, outer needle biasing spring 54 surrounds inner needle biasing spring 48 and is positioned in overlapping relationship with inner needle biasing spring 48 along the longitudinal axis of the injector. The inner end of outer needle biasing spring 54 engages a shim or seat 56 positioned in abutment against an annular land 58 formed on outer needle valve element 34. The upper end of outer needle biasing spring 54 engages an outer needle spacer or seat 59 positioned in abutment with spring housing 16.

Figure 3:
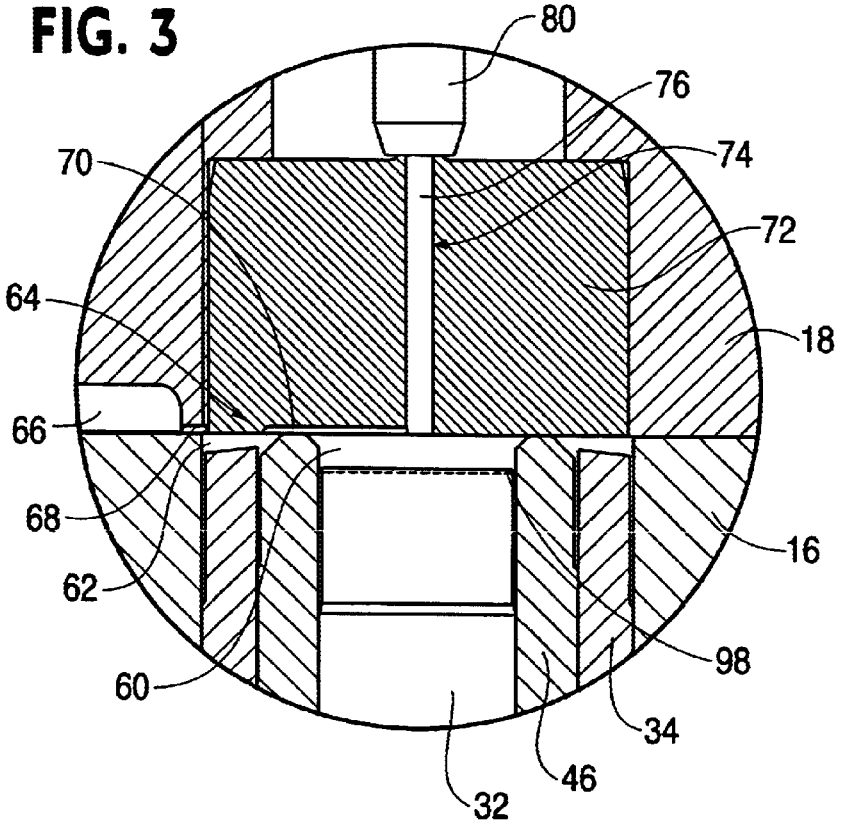
FIG. 3 is an expanded view of the area A of FIG. 2.

Referring to FIG. 3, closed needle injector assembly 10 also includes a first or inner control volume 60 formed within separator 46 adjacent the upper end of inner needle valve element 32 and a second or outer control volume 62 positioned outside separator 46 adjacent the upper end of second needle valve element 34. A control volume charge circuit 64 is provided for directing fuel from fuel transfer circuit 24 (FIG. 2) through outer control volume 62 and into inner control volume 60. Specifically, control volume charge circuit 64 includes a bridge passage 66 and inlet control passage 68 formed in valve housing 18, and a delivery control passage 70 formed in a valve seat piece 72 for connecting inner control volume 60 and outer control volume 62. Separator 46 is maintained in abutment against valve seat piece 72 causing delivery control passage 70 to be the only fluid connection between the control volumes. Closed needle injector assembly 10 also includes a drain circuit 74 including a drain passage 76 extending through valve seat piece 72 for draining fuel from inner control volume 60 to a low pressure drain. In addition, the closed needle injector assembly of the present invention includes an injection control valve, indicated generally at 78 (FIG. 2), positioned along drain circuit 74 for controlling the flow of fuel through drain circuit 74 so as to permit the controlled movement of inner needle valve element 32 and outer needle valve element 34. Injection control valve 78 includes a control valve member 80 biased into a closed position against a valve seat formed on valve seat piece 72 and surrounding the upper end of drain passage 76. Injection control valve 78 also includes an actuator assembly 82 (FIG. 2) capable of selectively moving control valve member 78 between open and closed positions. For example, actuator assembly 82 may be a fast proportional actuator, such as an electromagnetic, magnetostrictive or piezoelectric type actuator. Actuator assembly 82 may be a solenoid actuator assembly such as disclosed in U.S. Pat. Nos. 6,056,264 or 6,155,503, the entire contents of both of which are incorporated by reference.

Figure 4:
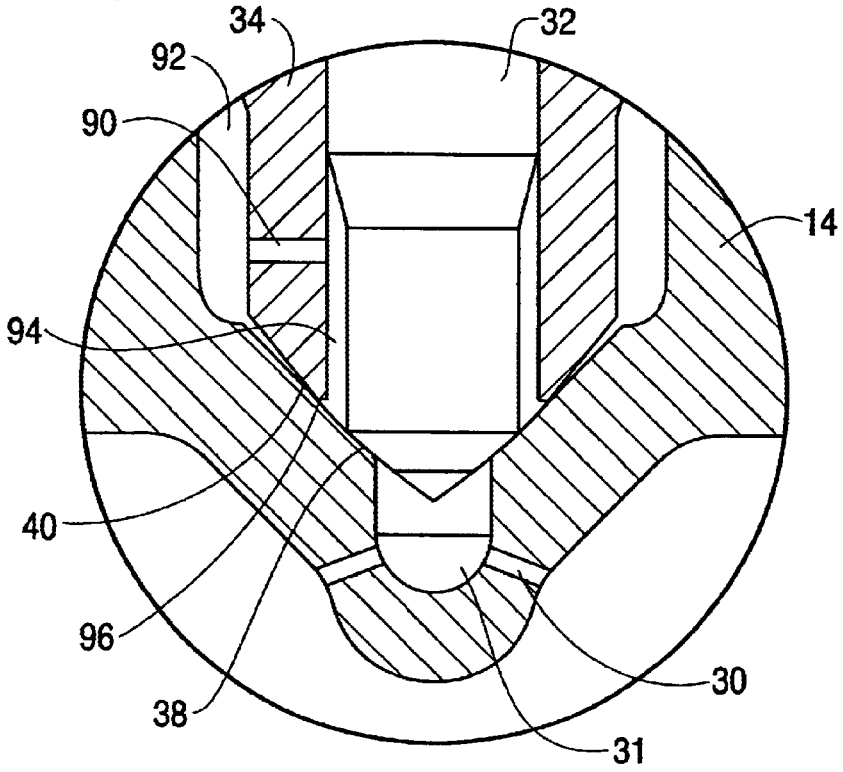
FIG. 4 is an expanded view of the area B of FIG. 2.

Referring to FIG. 4, the closed needle injector assembly 10 (FIG. 1) of the present invention importantly includes a throttle passage 90 formed in outer needle valve element 34 to restrict fuel flow upstream of injector orifices 30 when inner needle valve element 32 moves into the open position. Throttle passage 90 extends transversely through outer needle valve element 34 to fluidically connect an outer supply cavity 92 to an inner supply cavity 94 formed between inner needle valve element 32 and outer needle valve element 34. Throttle passage 90 preferably extends perpendicular to a longitudinal axis of the injector but, importantly, it is sized, relative to the total flow area of injector orifices 30, to produce a flow induced pressure drop upstream of inner needle valve element 32 in inner supply cavity 94. The pressure drop and thus the corresponding lower fuel pressure in inner supply cavity 94, reduces the pressure acting on the lower face of inner needle valve element 32 to improve its closing responsiveness and to provide an opportunity to prevent outer needle valve element 34 from lifting before inner needle valve element 32 has reached its uppermost open position against valve seat piece 72. The injector also includes a lift control device 96 in the form of a land formed on an inner portion of outer needle valve element 34 immediately adjacent second valve seat 40. It is desirable to prevent outer needle valve element 34 from lifting during short duration injections when inner needle valve element 32 travels ballistically between closed and open positions. It is also desirable to provide for robust sequencing of needle movements during longer duration injection events. Both objectives are achieved in the present invention by exposing a portion of outer needle valve element 34, that is, land 96, to the reduced fuel pressure existing within inner supply cavity 94 shortly after inner needle valve element 32 lifts from the closed position. Land 96 is formed by predisposing outer needle valve element 34 to seat against second valve seat 40 at its toe and truncating the toe slightly as shown. Lift control device or land 96 functions to reduce the total fuel pressure forces tending to move outer needle valve element 34 toward the open position as a fuel pressure in outer control volume 62 drops during an injection event thereby counterbalancing this pressure decrease and preventing outer needle valve element lift during short duration injections and delaying the lift of outer needle valve element 34 during longer duration injections.

Referring to FIGS. 1–4, during operation, with high pressure supply fuel present in fuel transfer circuit 24, outer supply cavity 92 and inner supply cavity 94, and with injection control valve 78 in its normally closed position blocking flow through drain circuit 74, all volumes within injector cavity 22 are pressurized to the supply fuel pressure level. This stand-by state is indicated at A in FIG. 7. While in this state, pressurized supply fuel surrounds inner needle valve element 32 in inner supply cavity 94 but is excluded from surfaces lying within the valve's heel-seated diameter and extending into the minisac region where lower pressure combustion chamber gases exist. Exclusion of the inner needle valve projected seat area results in a net hydraulic closing force keeping inner needle valve element 32 seated against first valve seat 38 in the closed position as shown in FIG. 4. This pressure dependent hydraulic force, combined with the preload of inner biasing spring 48, maintains inner needle element 32 firmly seated to prevent stand-by state leakage under all operating conditions. The toe seated outer needle valve element 34 is similarly surrounded by pressurized supply fuel. However, outer needle valve element 34 has no excluded surfaces and, therefore, does not experience a hydraulic force bias but is maintained in the closed position only by the preload of outer biasing spring 54.

Figure 7:
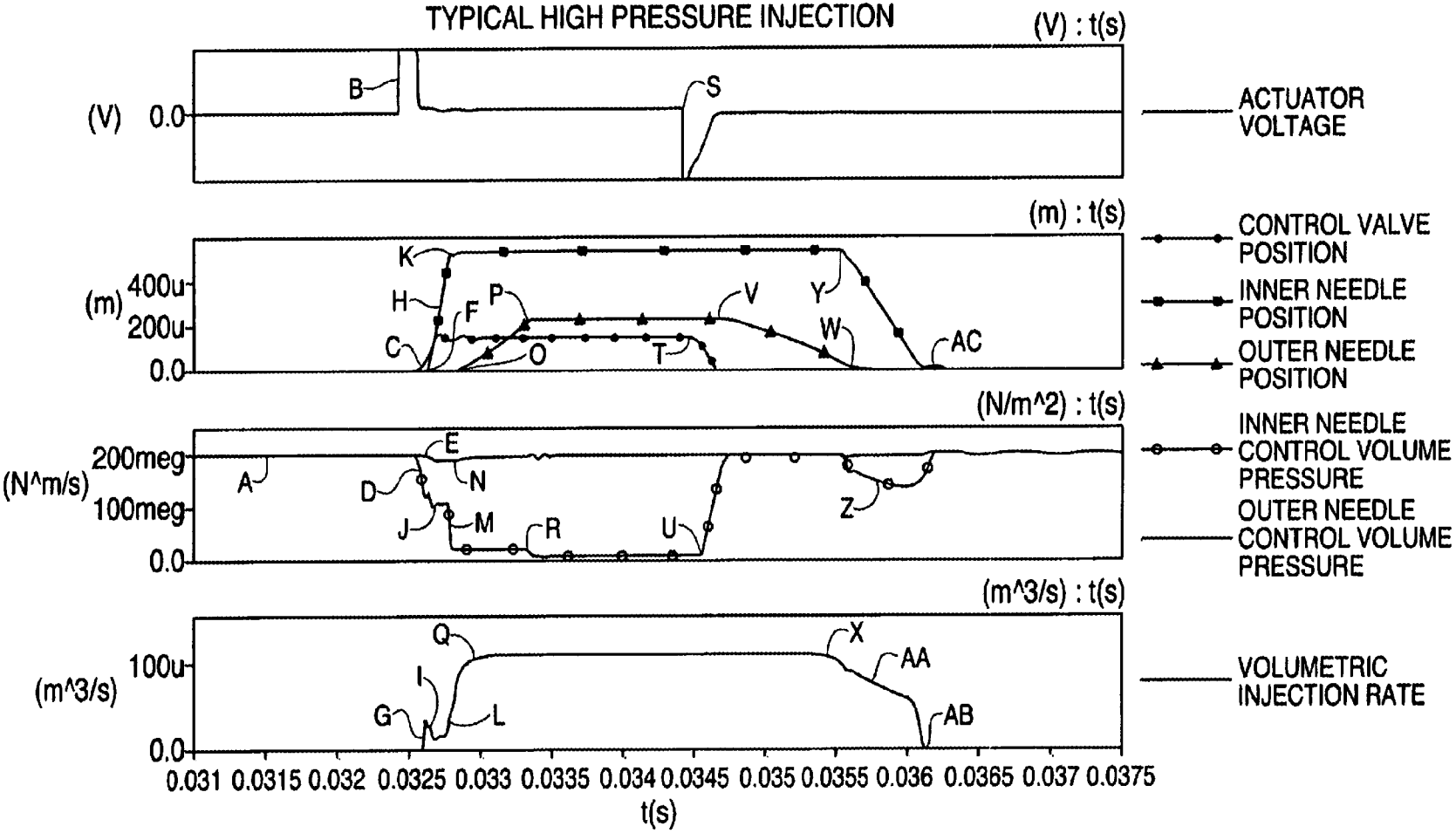
FIG. 7 is a graph showing actuator voltage, control valve position, inner needle position, inner control volume pressure, outer control volume pressure and volumetric injection rate versus time during a typical high pressure injection event with the injector of the present invention.

A fuel injection event is initiated by energizing actuator assembly 82 (B in FIG. 7) to move control valve member 80 into the open position (C in FIG. 7). Fuel pressure in both inner control volume 60 and outer control volume 62 drops (D and E in FIG. 7, respectively) as supply fuel flows through inlet passage 68, delivery control passage 70 and drain passage 76 into a low pressure drain. Inlet passage 68, delivery control passage 70 and drain passage 76 are sized relative to one another to produce a more rapid depressurization of inner control volume 60 than outer control volume 62. The depressurization reverses the combined hydraulic and return spring preload force bias on inner needle valve element 32 causing it to lift from first valve seat 38 (F in FIG. 7). As inner needle valve element 32 lifts from the closed position, fuel begins to flow from outer supply cavity 92 through throttle passage 90 into inner supply cavity 94. A fuel flow continues across first valve seat 38 into the minisac volume and through injector orifices 30 into the combustion chamber (not shown) where it is detected as fuel injection rate (G in FIG. 7). The hydraulic force acting to lift inner needle valve element 32 suddenly increases coincident with the pressurization of the minisac volume. Throttle passage 90 is sized, as noted above, with consideration for the total spray hole area, to produce a flow induced pressure drop upstream of inner needle valve element 32. This pressure drop reduces the pressure acting on the lower face of inner needle valve element 32 to improve its closing responsiveness and to provide an opportunity to prevent outer needle valve element 34 from lifting before inner needle valve element 32 has reached its uppermost position. As the pressure above outer needle valve element 34 in outer control volume 62 continues to drop, lift control device, i.e. land, 96 experiences a counterbalancing pressure drop as previously discussed. As outer needle valve element 34 remains seated in the closed position and inner needle valve element 32 accelerates toward valve seat piece 72 (H in FIG. 7), the fuel injection rate slows (I in FIG. 7) and the decay of inner control volume pressure is momentarily stopped (J in FIG. 7). The slowing of fuel injection rate is a consequence of the size of throttle orifice 90 and the resulting flow rate through throttle passage 90 being inadequate to maintain pressure in inner supply cavity 94 while feeding both the injector orifices 30 and an expanding void or size of inner supply cavity 94, produced by the retreating of inner needle valve element 32 away from the closed position. Once inner needle valve element 32 has reached its uppermost position against valve seat piece 72 (K in FIG. 7), fuel injection rate is quickly restored (L in FIG. 7) as throttle passage 90 again feeds only injector orifices 30. The duration of slowed fuel injection rate is largely determined by inner control valve element lift. The greater the lift of inner control valve element 32, the greater the duration; the smaller the lift, the shorter the duration. When increased inner needle valve element lift is desirable for rate shaping considerations, it is also beneficial to reduce inner needle valve element seat flow losses and to extend the duration available to inject fuel at a reduced delivery rate. The control valve actuator assembly 82 can be de-energized in advance of the inner needle valve element 32 reaching its full lift position to conclude an inner needle only fuel injection event, that is, a short duration injection event without the opening of outer needle valve element 34.

In the case of a longer duration injection event, actuator assembly 82 is maintained energized for a longer period of time thereby maintaining control valve member 80 in an open position so that inner needle valve element 32 achieves its full lift position and the pressure in inner control volume 60 resumes its decay (M in FIG. 7). Outer needle control volume 62 also resumes its shallower decay (N in FIG. 7). The combination of decreasing outer needle control volume pressure and increasing pressure in inner supply cavity 94 causes a quick reversal in the force bias keeping outer needle valve element 34 seated thereby causing outer needle valve element 34 to lift from the closed position toward the open position (O in FIG. 7). As outer control valve element 34 lifts, lift control device/land 96 is exposed to higher pressures as a low flow resistance path across second valve seat 40 is opened in parallel with throttle passage 90. The sudden exposure of land 96 to higher pressure results in a weakly bi-stable opening that can be tailored with outer needle spring preload. The design of outer needle valve element 34 is such that the flow restriction across second valve seat 40 becomes insignificant at even small lift values as evidenced by the abrupt increase in injection rate immediately following initial outer needle valve element 34 lift (L in FIG. 7). Because of this opening characteristic, it is acceptable that outer needle valve element 34 move more slowly and have a smaller maximum lift than inner needle valve element 32.

Unlike inner needle valve element 32, which abuts against the stop or valve seat piece 72 in its uppermost position, outer needle valve element 34 hovers in a state of force equilibrium near its upper stop (Q in FIG. 7). Force equilibrium is established and maintained by outer needle valve element 34 as it restricts fuel flow out of outer control volume 62. When the equilibrium is disturbed so as to cause outer needle valve element 34 to move toward the valve seat piece 72, the flow restriction increases, correspondingly increasing the pressure in outer control volume 62 and the resulting hydraulic force imbalance tending to close outer needle valve element 34. Conversely, as the equilibrium is disturbed so as to cause the outer needle valve element 34 to move away from valve seat piece 72, the flow restriction decreases, correspondingly decreasing the pressure in outer control volume 62 and the resulting hydraulic force imbalance tending to close outer needle valve element 34. The hovering of outer needle valve element 34 minimizes control flow rate and the associated rate of energy loss required to sustain the injection. A sudden drop in the pressure in inner control volume 60 (R in FIG. 7) coincident with the hovering (P in FIG. 7) of outer needle valve element 34 is an indication of a sudden drop in control flow rate as well.

The termination of fuel injection is initiated by de-energizing actuator assembly 82 (S in FIG. 7) which causes control valve member 80 to close (T in FIG. 7) blocking flow through drain passage 76. Fuel flowing from inlet passage 68 repressurizes inner and outer control volumes 60, 62 (U in FIG. 7) and, as a result, outer needle valve element 34 begins to close (V in FIG. 7). Inner needle valve element 32 remains against valve seat piece 72 in annular portion 98 formed on the top face of inner valve element 32. Annular portion 98 seals against the valve seat piece 72 preventing the increased control volume pressure from gaining access to this portion of the valve element. As outer needle valve element 34 approaches second valve seat 40 (W in FIG. 7), fuel flow to inner supply cavity 94 again becomes controlled by throttle orifice 90 causing the pressure in inner supply cavity 94 to decrease and the injection rate to also decrease (X in FIG. 7). Consequently, the closing of inner needle valve element is initiated (Y in FIG. 7). The rapidly closing inner needle valve element 32 reduces the pressure in inner control volume 60 (Z in FIG. 7) and provides beneficial pumping to bolster the slowing injection rate (AA in FIG. 7). Fuel injection is terminated when inner needle valve element 32 reaches the closed position against first valve seat 38 (AB in FIG. 7). The pumping affect of inner needle valve element 32 at the moment of seating is sufficient to upset outer needle valve element 34 (AC in FIG. 7). This upsetting provides a beneficial re-centering of outer needle valve element 34 relative to the seated inner needle valve element 32 that is closely guided within it. This re-centering after each injection event helps to reduce metering variability particularly in small quantity pilot and post injections.

Figure 5:
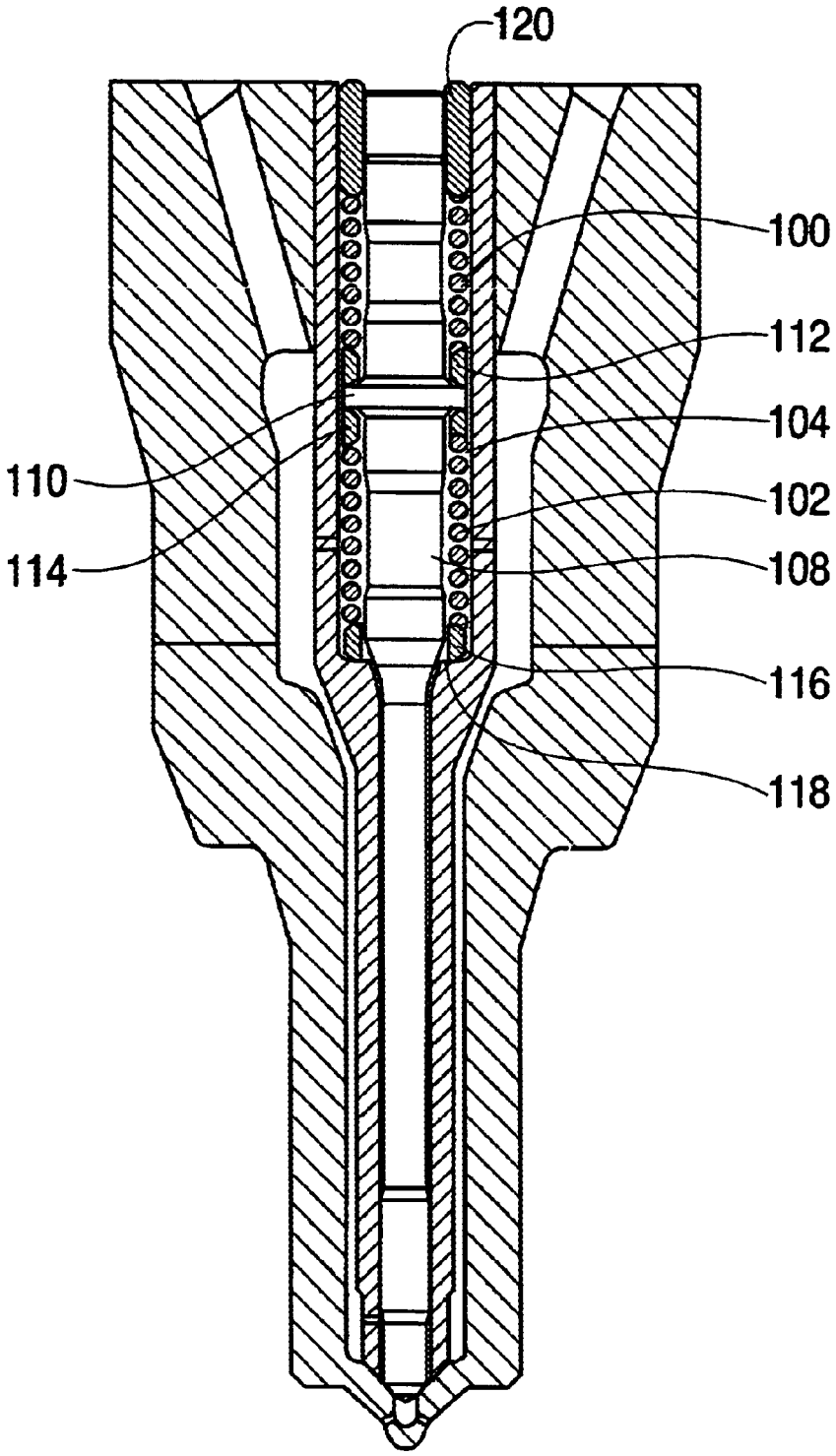
FIG. 5 is a cross-sectional view of a second embodiment of the closed nozzle injector of the present invention.
Figure 6A:
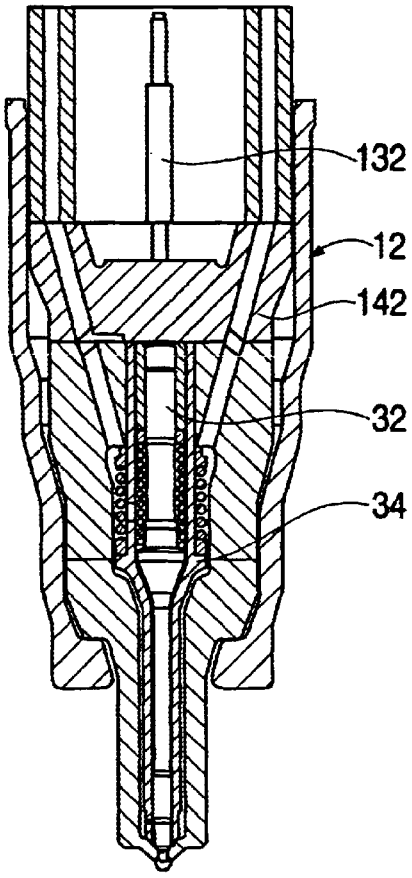
FIGS. 6*a*–6*d* are various cross sectional views of an alternative embodiment of the present invention.
Figure 6C:
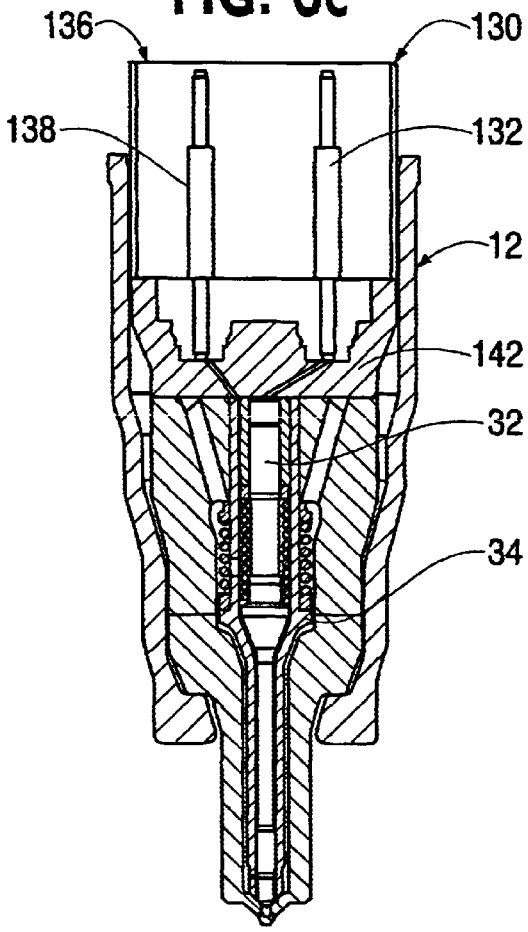
Figure 6B:
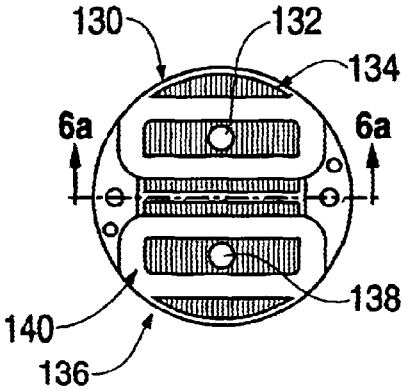
Figure 6D:
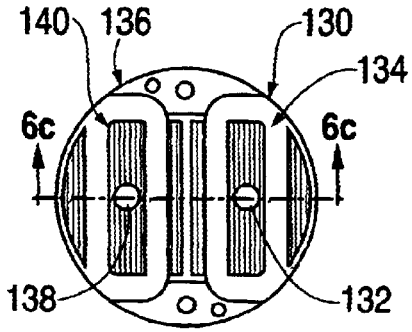

FIG. 5 discloses another embodiment of the closed needle injector assembly of the present invention which is essentially the same as the previous embodiment of FIGS. 1–4 except that an inner needle biasing spring 100 and an outer needle biasing spring 102 are positioned within a cavity 104 formed in outer needle valve element 106. That is, inner biasing spring 100 and outer biasing spring 102 are positioned, packaged, and operate in series along the longitudinal axis of the injector, instead of the overlapping, independently operable arrangement of the previous embodiment. Inner needle valve element 108 includes a land 110 functioning to support a lower inner spring seat 112 and an upper outer spring seat 114. The lower end of outer biasing spring 102 is seated against a lower outer spring seat 116 which in turn abuts an annular surface 118 formed within outer needle valve element 106 thus permitting needle valve element 106 to be biased into the closed position by outer biasing spring 102. The upper end of inner biasing spring 100 abuts a separator 120. This embodiment results in a smaller radial dimension more compatible with small bore light and medium duty diesel engines.

FIGS. 6*a*–6*d* illustrate another embodiment of the present invention which is similar to the first embodiment of FIGS. 1–4 except that inner needle valve element 32 and outer needle valve element 34 are independently controlled using separate injection control valves. Specifically, a first injection control valve 130 is mounted within injector body 12 for controlling the movement of inner needle valve element 32 and includes a reciprocally mounted, selectively movable control valve member 132 actuated by a first actuator assembly 134. Similarly, a second injection control valve 136 is mounted adjacent first injection control valve 130 and includes a reciprocally mounted, selectively movable control valve member 138 actuated by a second actuator 140 mounted adjacent first actuator 134 within injector body 12. A lower valve housing 142 is modified from the valve housing of the first embodiment to accommodate the two injection control valves.

Figure 8:
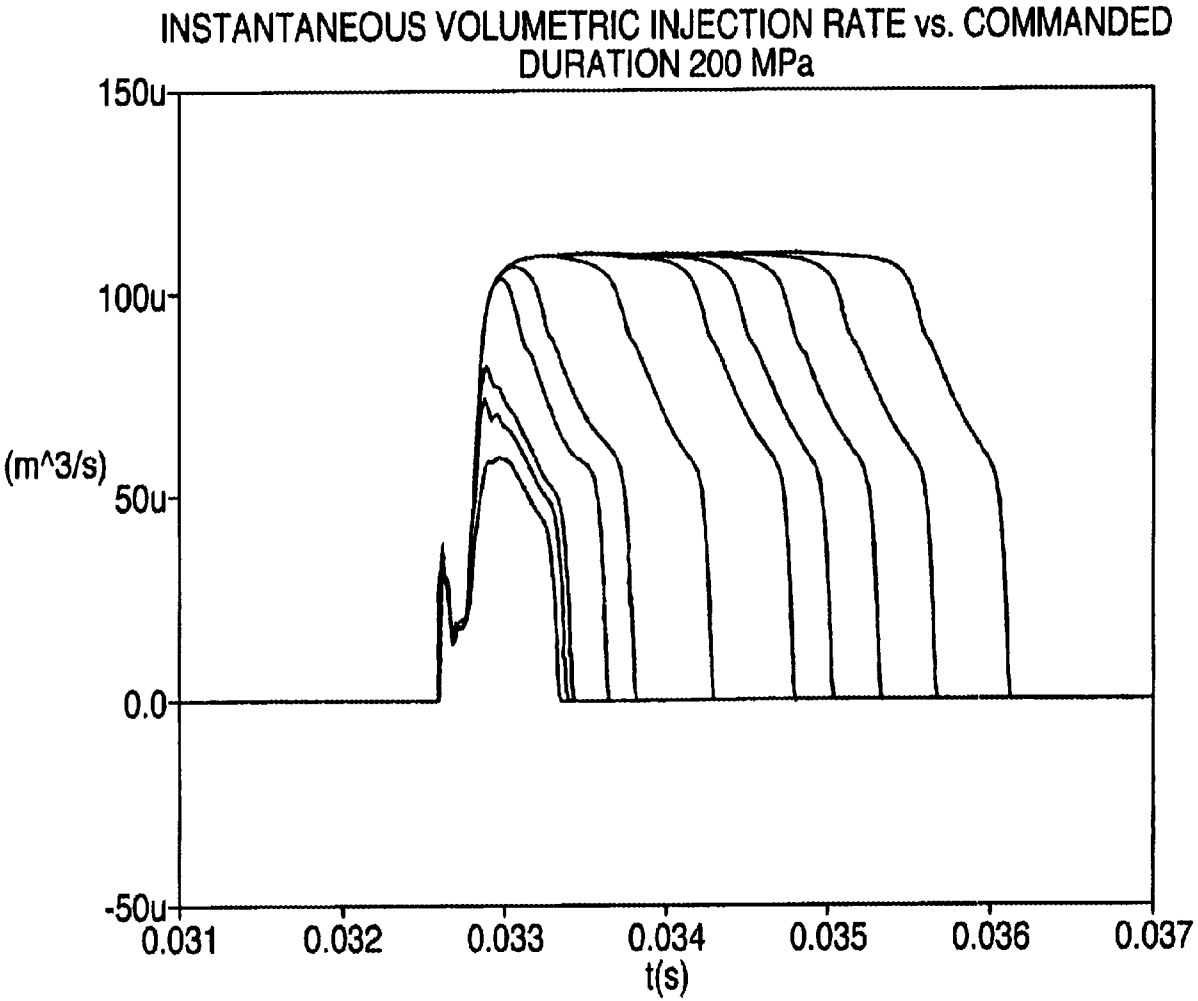
FIG. 8 is a graph showing instantaneous volumetric injection rate versus commanded duration a constant supply fuel pressure with the fuel injector of the present invention.
Figure 9:
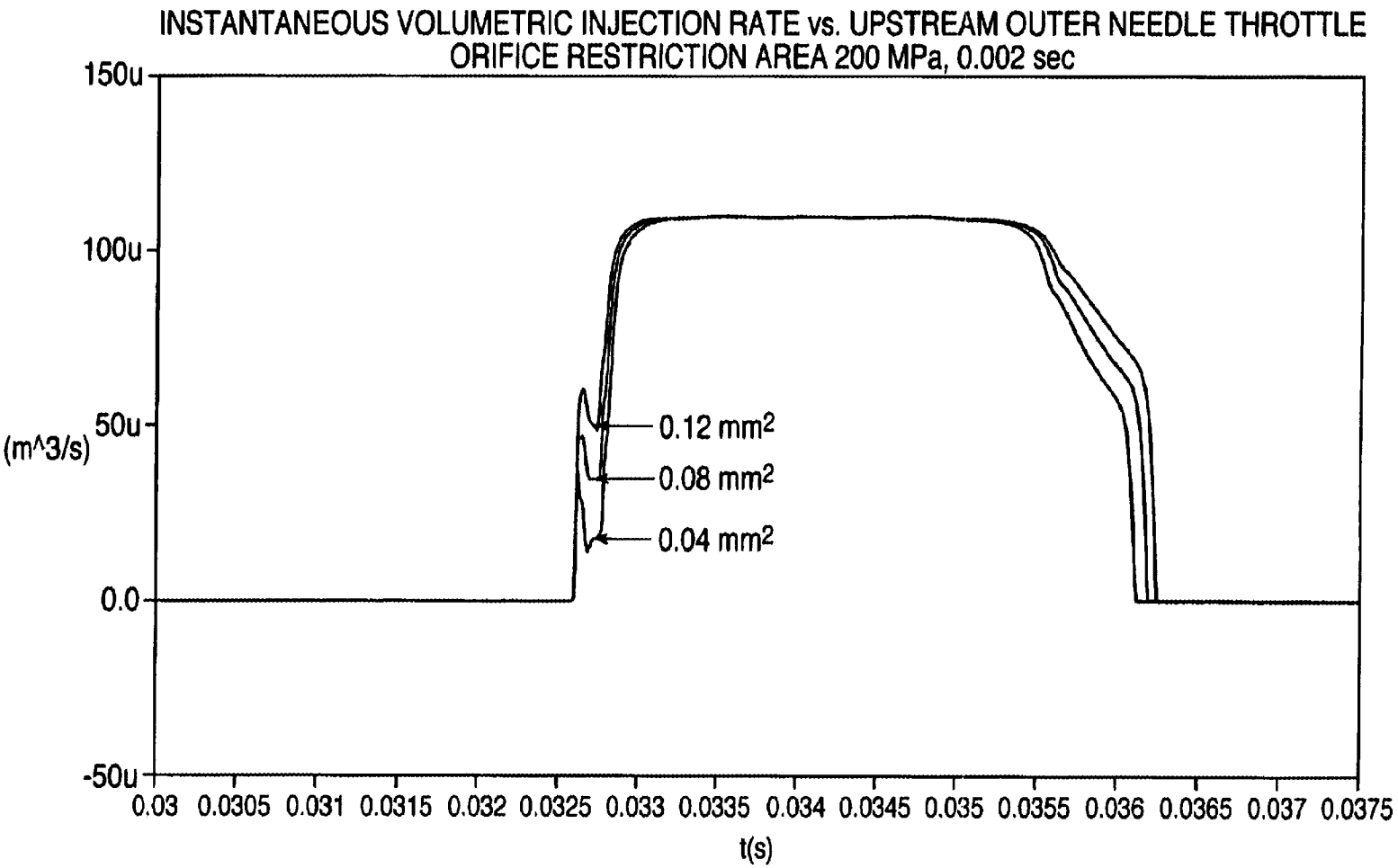
FIG. 9 is a graph showing instantaneous volumetric injection rate versus time during a given injection event for various upstream outer needle throttle orifice restriction areas with the injector of the present invention.
Figure 10:
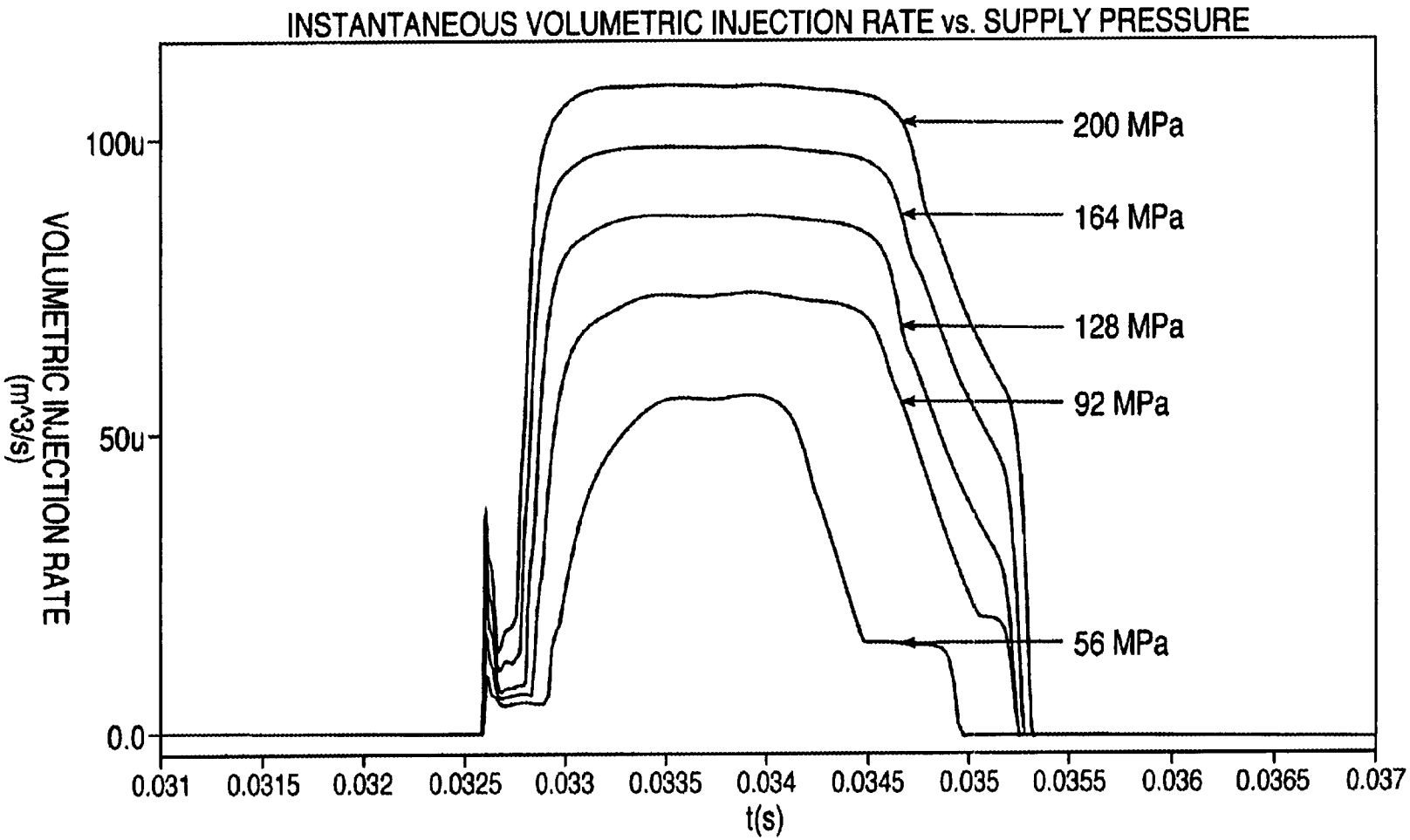
FIG. 10 is a graph showing instantaneous volumetric injection rate versus time for a given injection event at various supply pressures using the injector of the present invention.
Figure 11:
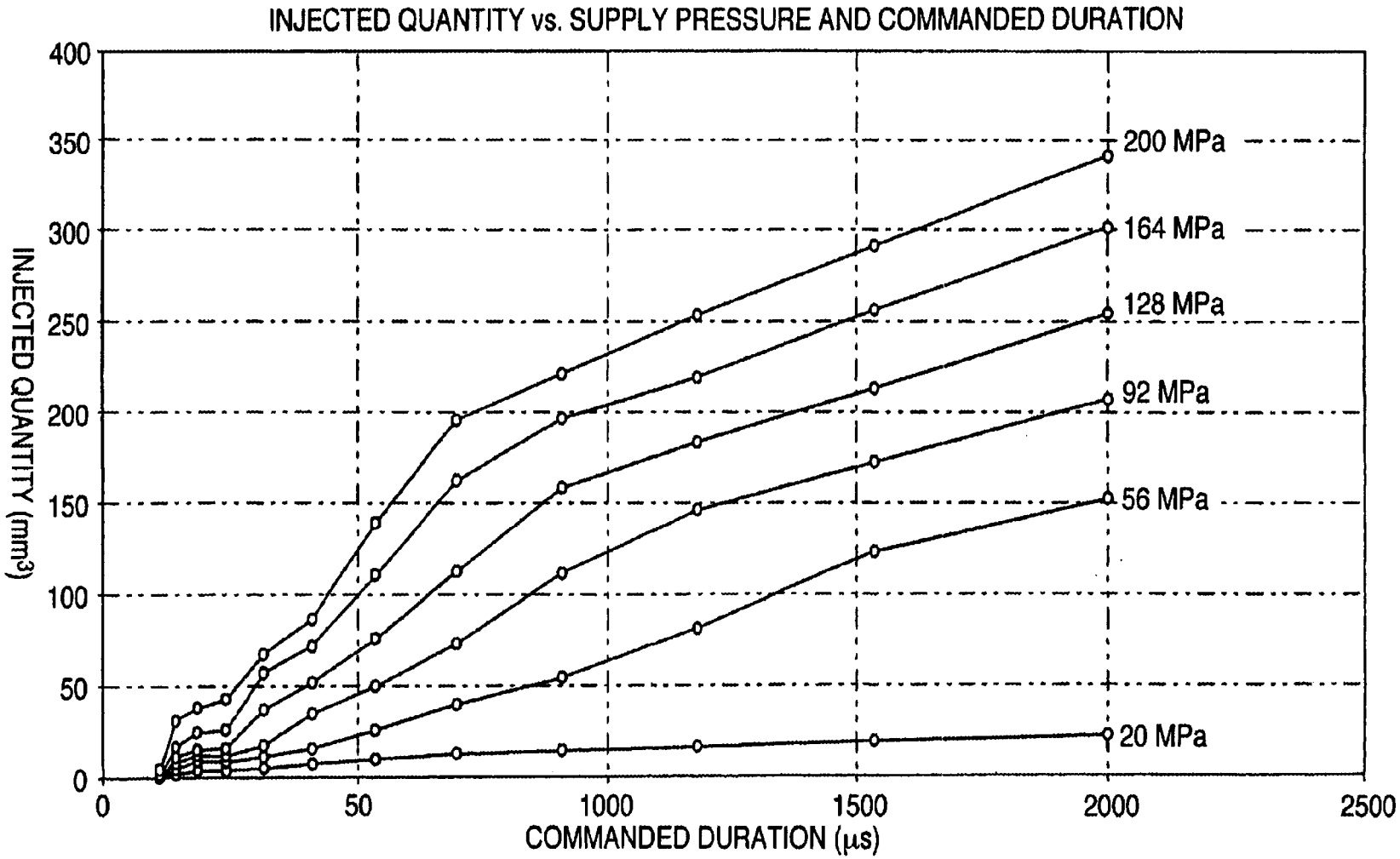
FIG. 11 is a graph showing injected quantity versus commanded injection event duration at various supply pressures for the injector of the present invention.

FIG. 8 illustrates the advantage of the present invention in maintaining a pilot injection of a desirable duration and separation regardless of the subsequent duration of a longer main injection event. FIG. 9 illustrates how the pilot portion of the injection rate shape is sensitive to the size of the throttle passage/orifice 90 formed in outer needle valve element 34. In the base case, the orifice is set at 0.04 $mm^2$ compared to a total spray hole area of 0.2 $mm^3$. Increasing the throttling orifice area first to 0.08 $mm^2$ and then to 0.12 $mm^2$ has the effect of transforming a low flow rate semi-attached pilot into a higher flow rate pilot attached to the primary injection. FIG. 10 is similar to FIG. 8 and illustrates the effectiveness of the closed needle injector assembly of the present invention throughout various supply pressure levels. FIG. 11 illustrates one of the primary advantages of the present invention in providing more favorable fuel gain response at low fueling quantities. The closed needle injector assembly of the present invention effectively shifts a portion of undesirable steep gain response away from the commanded duration used for small quantity pilot and post injections into a region of higher quantity injections where it is not critical to achieve ultimate absolute fuel accuracy.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device especially during short duration injections or pilot injections. Such internal combustion engines including a fuel injector in accordance with the present invention can be widely used in all industrial fields and non-commercial applications, including trucks, passenger cars, industrial equipment, stationary power plant and others.

We claim:

1. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a first needle valve element positioned in said injector cavity for controlling fuel flow through said injector orifice and a first valve seat formed on said injector body, said first needle valve element movable between a closed position against said first valve seat blocking flow through said injector orifice and an open position permitting flow through said injector orifice;

a second needle valve element positioned in said injector cavity, said second valve element movable between a closed position against a second valve seat blocking fuel flow across said second valve seat and an open position permitting fuel flow across said second valve seat, said first needle valve element adapted to move from said closed position to said open position while said second needle valve element is positioned in said closed position;

a throttle passage formed in said second needle valve element to restrict fuel flow upstream of said injector orifice;

a first control volume positioned adjacent an upper end of said first needle valve element for receiving fuel;

a second control volume positioned adjacent an upper end of said second needle valve element for receiving fuel; and an injection control valve means for controlling the flow of fuel from said first and said second control volumes.

2. The injector of claim 1, wherein said first needle valve element is telescopingly received within a cavity formed in said second needle valve element to form a sliding fit with an inner surface of said second needle valve element.

3. The injector of claim 1, further including a drain circuit for draining fuel from said first control volume and said second control volume to a low pressure drain, said injection control valve means further including a first injection control valve positioned along said drain circuit for controlling the flow of fuel through said drain circuit to control movement of said first needle valve element between said open and said closed positions and a second injection control valve positioned along said drain circuit for controlling the flow of fuel through said drain circuit to control movement of said second needle valve element between said open and said closed positions.

4. The injector of claim 3, wherein said first and said second injection control valves each include an actuator and a reciprocally mounted, selectively movable control valve member.

5. The injector of claim 4, wherein said actuators for said first and said second needle valve elements are positioned adjacent one another in side-by-side relationship with respective axes of reciprocation of said control valve members positioned in parallel.

6. The injector of claim 1, further including a first biasing spring for biasing said first needle valve element toward said closed position and a second biasing spring for biasing said second needle valve element toward said closed position, both of said first and said second biasing springs positioned within said cavity formed in said second needle valve element.

7. The injector of claim 6, wherein said first and said second biasing springs are positioned in nonoverlapping serial relationship along a longitudinal axis.

8. The injector of claim 1, wherein said throttle passage extends transversely through said second needle valve element from an outer supply cavity to an inner supply cavity.

9. The injector of claim 8, wherein said throttle passage extends substantially perpendicular to a longitudinal axis of said injector body.

10. The injector of claim 1, wherein said second needle valve element includes a land formed on an inner portion of said second needle valve element immediately adjacent said second valve seat.

11. The injector of claim 1, further including an outer cavity surrounding said second needle valve element and an inner supply cavity formed within said second needle valve element, further including a lift control means positioned within said inner supply cavity for controlling the movement of said second needle valve element from said closed position.

12. The injector of claim 11, wherein said lift control means includes a land formed on said second needle valve element and exposed to fuel in said inner supply cavity to generate fuel pressure forces tending to open said second needle valve element.

13. A closed needle injector assembly for injecting fuel into the combustion chamber of an engine, comprising:

an injector body containing an injector cavity and only one set of injector orifices communicating with one end of said injector cavity to discharge fuel into the combustion chamber, said injector body including a fuel transfer circuit for transferring supply fuel to said only one set of injector orifices;

an outer needle valve element positioned in said injector cavity, said outer needle valve element movable between a closed position against an outer valve seat blocking fuel flow across said outer valve seat and an open position permitting fuel flow across said outer valve seat;

an inner needle valve element telescopingly received within a cavity formed in said outer needle valve element for controlling fuel flow through said only one set of injector orifices and an inner valve seat formed on said injector body, said inner valve element movable between a closed position against said inner valve seat blocking flow through said only one set of injector orifices and an open position permitting flow through said only one set of injector orifices;

an outer supply cavity surrounding said outer needle valve element;

an inner supply cavity positioned within said cavity formed in said outer needle valve element;

a throttle passage extending through said outer needle valve element to fluidically connect said outer supply cavity and said inner supply cavity, said throttle passage sized to restrict fuel flow to said inner supply cavity.

14. The injector of claim 13, further including a first control volume positioned adjacent an upper end of said first needle valve element, a second control volume positioned adjacent an upper end of said second needle valve element and a control volume charge circuit for supplying fuel from said fuel transfer circuit to said first and said second control volumes.

15. The injector of claim 14, further including an injection control valve means for controlling the flow of fuel to said outer and said inner control volumes.

16. The injector of claim 15, further including a drain circuit for draining fuel from said inner and said outer control volumes to a low pressure drain, said injection control valve means further including an outer injection control valve positioned along a drain circuit for controlling the flow of fuel through said drain circuit to control movement of said outer needle valve element between said open and said closed positions and an inner injection control valve positioned along said drain circuit for controlling the flow of fuel through said drain circuit to control movement of said inner needle valve element between said open and said closed positions.

17. The injector of claim 13, wherein said throttle passage extends substantially perpendicular to a longitudinal axis of said injector body.

18. The injector of claim 13, wherein said outer needle valve element includes a land formed on an inner portion of said outer needle valve element immediately adjacent said outer valve seat.

19. The injector of claim 13, further including a lift control means positioned within said inner supply cavity for controlling the movement of said outer needle valve element from said closed position.

20. The injector of claim 19, wherein said lift control means includes a land formed on said outer needle valve element and exposed to fuel in said inner supply cavity to generate fuel pressure forces tending to open said outer needle valve element.

21. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a first needle valve element positioned in said injector cavity for controlling fuel flow through said injector orifice and a first valve seat formed on said injector body, said first needle valve element movable between a closed position against said first valve seat blocking flow through said injector orifice and an open position permitting flow through said injector orifice;

a second needle valve element positioned in said injector cavity, said second valve element movable between a closed position against a second valve seat blocking fuel flow across said second valve seat and an open position permitting fuel flow across said second valve seat;

a throttle passage formed in said second needle valve element to restrict fuel flow upstream of said injector orifice;

a first control volume positioned adjacent an upper end of said first needle valve element for receiving fuel;

a second control volume positioned adjacent an upper end of said second needle valve element for receiving fuel;

an injection control valve means for controlling the flow of fuel from said first and said second control volumes; and a drain circuit for draining fuel from said first control volume and said second control volume to a low pressure drain, said injection control valve means further including a first injection control valve positioned along said drain circuit for controlling the flow of fuel through said drain circuit to control movement of said first needle valve element between said open and said closed positions and a second injection control valve positioned along said drain circuit for controlling the flow of fuel through said drain circuit to control movement of said second needle valve element between said open and said closed positions.

22. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a first needle valve element positioned in said injector cavity for controlling fuel flow through said injector orifice and a first valve seat formed on said injector body, said first needle valve element movable between a closed position against said first valve seat blocking flow through said injector orifice and an open position permitting flow through said injector orifice;

a second needle valve element positioned in said injector cavity, said second valve element movable between a closed position against a second valve seat blocking fuel flow across said second valve seat and an open position permitting fuel flow across said second valve seat;

a throttle passage formed in said second needle valve element to restrict fuel flow upstream of said injector orifice;

a first control volume positioned adjacent an upper end of said first needle valve element for receiving fuel;

a second control volume positioned adjacent an upper end of said second needle valve element for receiving fuel;

an injection control valve means for controlling the flow of fuel from said first and said second control volumes; and an outer cavity surrounding said second needle valve element and an inner supply cavity formed within said second needle valve element, further including a lift control means positioned within said inner supply cavity for controlling the movement of said second needle valve element from said closed position.

23. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

an outer needle valve element positioned in said injector cavity, said second valve element movable between a closed position against an outer valve seat blocking fuel flow across said outer valve seat and an open position permitting fuel flow across said outer valve seat;

an inner needle valve element telescopingly received within a cavity formed in said outer needle valve element for controlling fuel flow through said injector orifice and an inner valve seat formed on said injector body, said inner valve element movable between a closed position against said inner valve seat blocking flow through said injector orifice and an open position permitting flow through said injector orifice;

an outer supply cavity surrounding said outer needle valve element;

an inner supply cavity positioned within said cavity formed in said outer needle valve element;

a throttle passage extending through said outer needle valve element to fluidically connect said outer supply cavity and said inner supply cavity, said throttle passage sized to restrict fuel flow to said inner supply cavity; and a drain circuit for draining fuel from said inner and said outer control volumes to a low pressure drain, said injection control valve means further including an outer injection control valve positioned along a drain circuit for controlling the flow of fuel through said drain circuit to control movement of said outer needle valve element between said open and said closed positions and an inner injection control valve positioned along said drain circuit for controlling the flow of fuel through said drain circuit to control movement of said inner needle valve element between said open and said closed positions.

24. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

an outer needle valve element positioned in said injector cavity, said second valve element movable between a closed position against an outer valve seat blocking fuel flow across said outer valve seat and an open position permitting fuel flow across said outer valve seat;

an inner needle valve element telescopingly received within a cavity formed in said outer needle valve element for controlling fuel flow through said injector orifice and an inner valve seat formed on said injector body, said inner valve element movable between a closed position against said inner valve seat blocking flow through said injector orifice and an open position permitting flow through said injector orifice;

an outer supply cavity surrounding said outer needle valve element;

an inner supply cavity positioned within said cavity formed in said outer needle valve element;

a throttle passage extending through said outer needle valve element to fluidically connect said outer supply cavity and said inner supply cavity, said throttle passage sized to restrict fuel flow to said inner supply cavity; and a lift control means positioned within said inner supply cavity for controlling the movement of said outer needle valve element from said closed position.

25. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a first needle valve element positioned in said injector cavity for controlling fuel flow through said injector orifice and a first valve seat formed on said injector body, said first needle valve element movable between a closed position against said first valve seat blocking flow through said injector orifice and an open position permitting flow through said injector orifice;

a second needle valve element positioned in said injector cavity, said second valve element movable between a closed position against a second valve seat blocking fuel flow across said second valve seat and an open position permitting fuel flow across said second valve seat;

a throttle passage formed in said second needle valve element to restrict fuel flow upstream of said injector orifice;

a first control volume positioned adjacent an upper end of said first needle valve element for receiving fuel;

a second control volume positioned adjacent an upper end of said second needle valve element for receiving fuel;

an injection control valve means for controlling the flow of fuel from said first and said second control volumes; and a first biasing spring for biasing said first needle valve element toward said closed position and a second biasing spring for biasing said second needle valve element toward said closed position.

26. A closed needle injector assembly for injecting fuel into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a first needle valve element positioned in said injector cavity for controlling fuel flow through said injector orifice and a first valve seat formed on said injector body, said first needle valve element movable between a closed position against said first valve seat blocking flow through said injector orifice and an open position permitting flow through said injector orifice;

a second needle valve element positioned in said injector cavity, said second valve element movable between a closed position against a second valve seat blocking fuel flow across said second valve seat and an open position permitting fuel flow across said second valve seat;

a throttle passage formed in said second needle valve element to restrict fuel flow upstream of said injector orifice;

a first control volume positioned adjacent an upper end of said first needle valve element for receiving fuel;

a second control volume positioned adjacent an upper end of said second needle valve element for receiving fuel, said second control volume positioned adjacent said first control volume along an axial extent of the injector; and an injection control valve means for controlling the flow of fuel from said first and said second control volumes.

* * * * *